US007066054B2

(12) United States Patent
Liu

(10) Patent No.: US 7,066,054 B2
(45) Date of Patent: Jun. 27, 2006

(54) RATCHET WRENCH

(76) Inventor: Kuo-Chen Liu, No. 31, Industrial 12th Road, Ta-Li City, Taichung (TW)

( * ) Notice: Subject to any disclaimer, the term of this patent is extended or adjusted under 35 U.S.C. 154(b) by 180 days.

(21) Appl. No.: 10/804,049

(22) Filed: Mar. 19, 2004

(65) Prior Publication Data

US 2005/0204868 A1 Sep. 22, 2005

(51) Int. Cl.
*B25B 13/46* (2006.01)

(52) U.S. Cl. ..... 81/58.4; 81/62; 192/43.1

(58) Field of Classification Search ..... 81/58.1, 81/58.4, 60–63.2, 438; 192/43.1, 43.2
See application file for complete search history.

(56) References Cited

U.S. PATENT DOCUMENTS 4,404,874 A * 9/1983 Lieser ..... 81/438
6,260,446 B1 * 7/2001 Hu ..... 81/62
6,644,147 B1 * 11/2003 Huang ..... 81/62
2005/0204869 A1 * 9/2005 Shu ..... 81/58.4

* cited by examiner

*Primary Examiner*—Hadi Shakeri

(57) ABSTRACT

A ratchet wrench includes a base connected to a handle and a cylindrical top on the base has two recesses for receiving two pawls therein. Each recess includes a hole in an inner bottom thereof so that the two pawls are pivotably inserted in the two holes by their respective shafts. A ring is rotatably mounted to the cylindrical top and has a concaved area for allowing at least one of the two pawls to be extended outward. A driving member having a skirt portion which has teeth defined in an inner periphery thereof and the teeth are engaged with at least one of the two pawls. The base is easily to be manufactured and the two shafts of the two pawls are easily to be assembled in the recesses.

4 Claims, 6 Drawing Sheets

RATCHET WRENCH

FIELD OF THE INVENTION

The present invention relates to a ratchet wrench that is easily to be assembled and manufactured.

BACKGROUND OF THE INVENTION

A conventional roller ratchet wrench is disclosed in FIGS. 9 and 10, and generally includes a base 100 which includes two recesses 101 defined in an outer periphery of a cylindrical top and an insertion 102 which is inserted in a handle 400. Each recess 101 has a pin 103 extending from an inner bottom thereof such that two pawls 200 are respectively mounted onto the two pins 103. The two pawls 200 are biased respectively by two springs 201 so as to keep them extend outward. A driving member 300 is connected to the cylindrical top of the base 100 and includes a skirt portion which has teeth 301 defined in an inner periphery thereof so as to be engaged with the pawls 200 during operation. A receiving hole 302 is defined in a top of the driving member 300 so as to receive a screw bit therein which is not shown. A ring 303 is mounted to the cylindrical top and sandwiched between the skirt portion of the driving member 300 and a flange 104 on the base 100. The ring 303 includes three notches 304 for being engaged with a bead 105 which is biased by a spring 106, and both of the spring 106 and the bead 105 are received in a hole 107 in the outer periphery of the cylindrical top. The ring 303 further includes a concaved area 305 in which the pawls 200 can be extended outward to engage with the teeth 301 of the driving member 300. When adjusting the ring 303 to position the pawls 200 out from the concaved area 305, the pawls 200 are pushed inward by the inner periphery of the ring 303 and do not engage with the teeth 301. By rotating the ring 303, the user can choose the pawls 200 to be engaged with the teeth 301 of the driving member 300. Nevertheless, when manufacturing the base 100, the two pins 103 are so tiny and close to the inside of the recess 101 so that they are difficult to be manufactured.

The present invention intends to provide an improved base structure that allows the manufacturers to easily manufacture the base by using molds with simple structure.

SUMMARY OF THE INVENTION

The present invention relates to a ratchet wrench that comprises a base connected to a handle and including a cylindrical top. Two recesses are defined in an outer periphery of the cylindrical top and a hole is defined in an inner bottom of each of the two recesses. A receiving hole is defined in an outer periphery of the cylindrical top so as to receive a first spring and a bead therein. Two pawls are respectively inserted in the two holes in the two recesses by the two respective shafts of the two pawls and two second springs are respectively biased between the two pawls and two respective insides of the two recesses.

A ring is rotatably mounted to the cylindrical top and has three notches defined in an inner periphery thereof. The bead is engaged with one of the notches and a concaved area is defined in the inner periphery of the ring so as to receive the two pawls. A driving member has an engaging top section and a skirt portion in which teeth are defined and engaged with the at least one of the two ratchet teeth of the two pawls. The ring is sandwiched between a flange extending from the base and a lower edge of the skirt portion of the driving member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
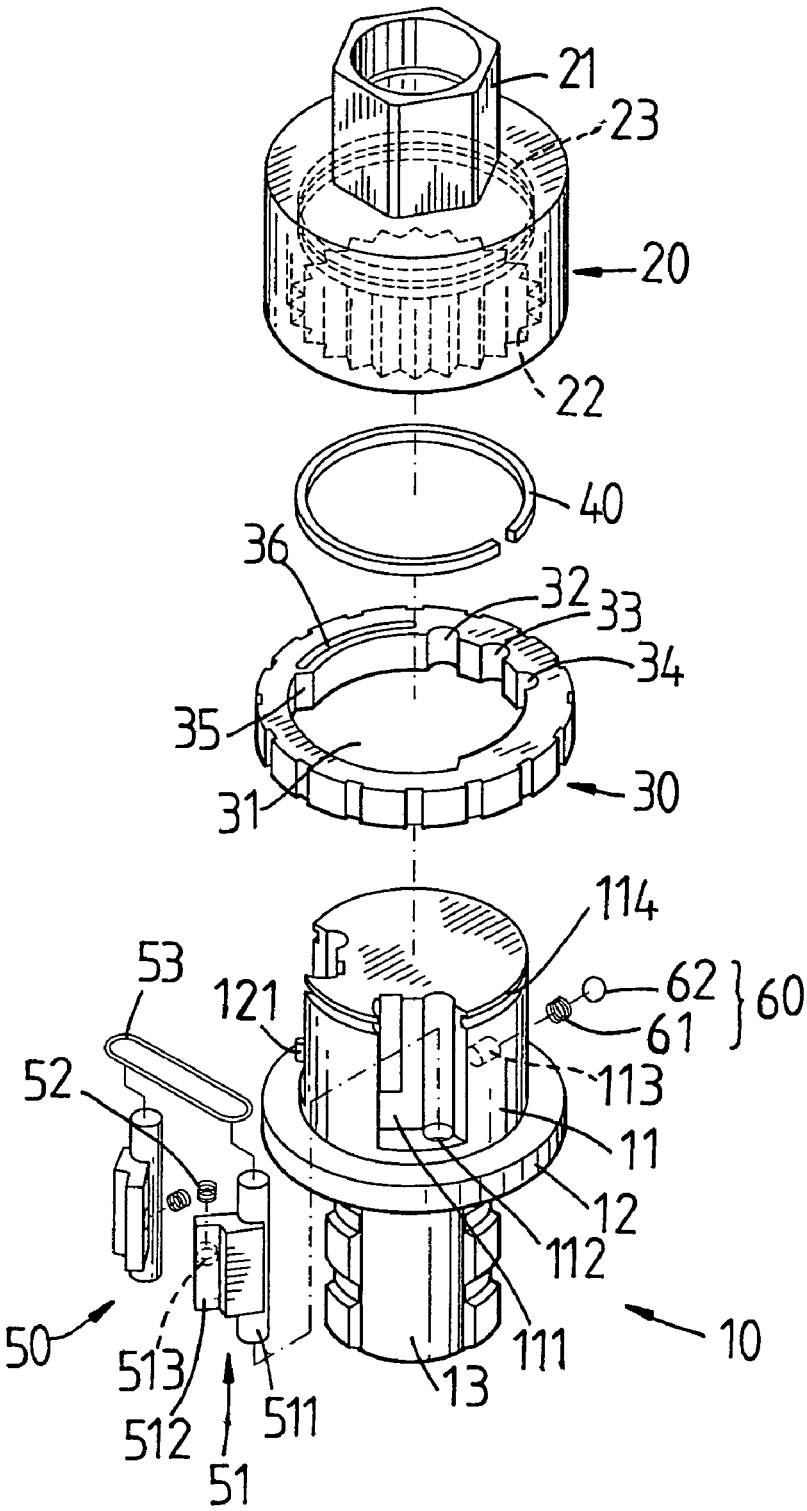
FIG. 1 is an exploded view to show the ratchet wrench of the present invention.
Figure 2:
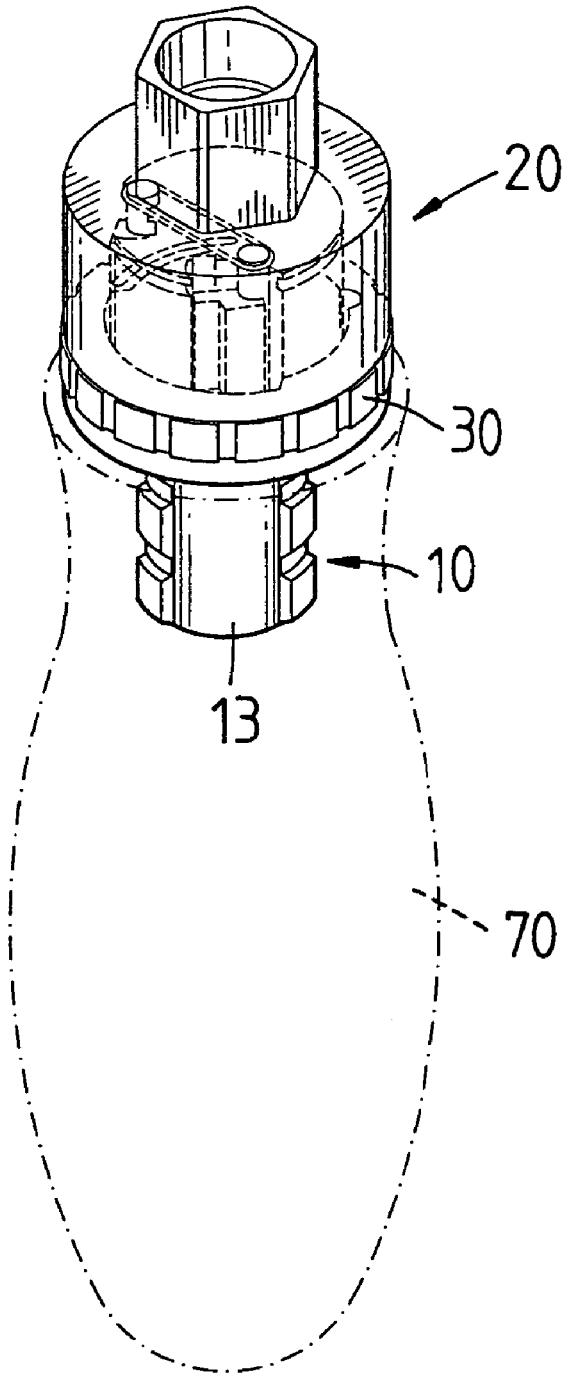
FIG. 2 is a perspective view to show the ratchet wrench of the present invention.
Figure 3:
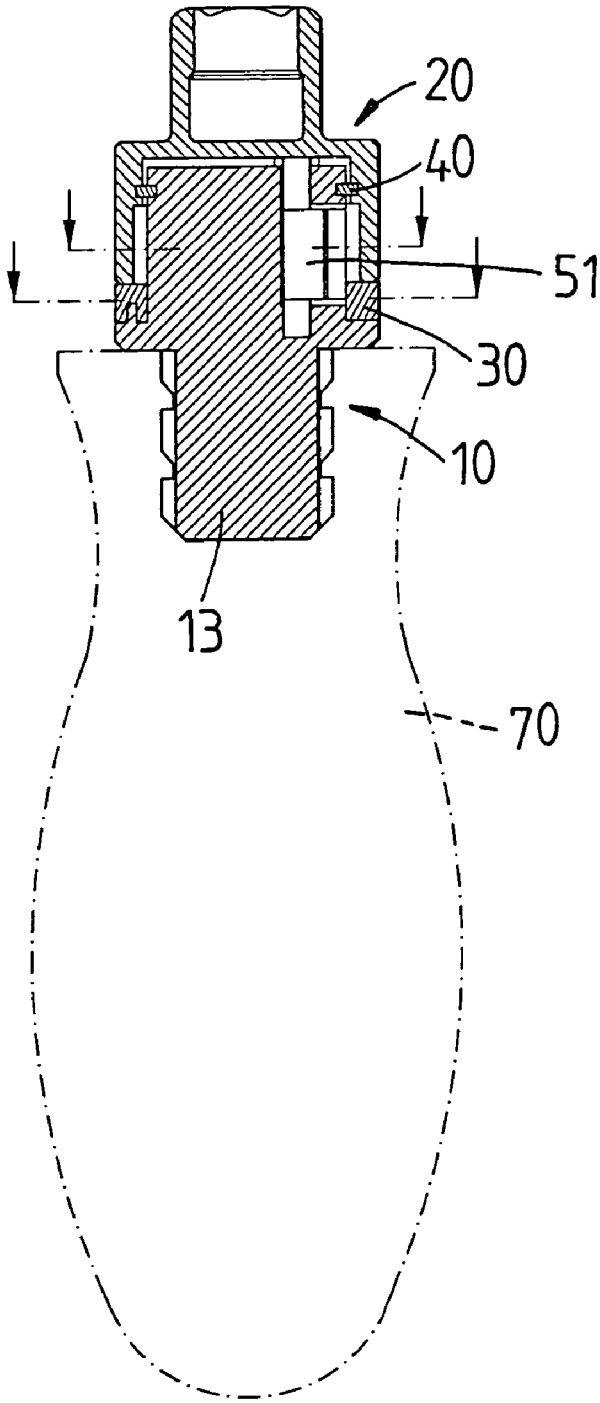
FIG. 3 is a cross sectional view of the ratchet wrench of the present invention.

Referring to FIGS. 1 to 4, the ratchet wrench of the present invention comprises a base 10 including a cylindrical top 11, a flange 12 extending radially outward from the cylindrical top 11 and an insertion 13 extending from an underside of the flange 12 and located on opposite to the cylindrical top 11. The insertion 13 is fixedly inserted in a handle 70. Two recesses 111 are defined in an outer periphery of the cylindrical top 11 and a hole 112 is defined in an inner bottom of each of the two recesses 111. A receiving hole 113 is defined in an outer periphery of the cylindrical top 11 so as to receive a positioning mechanism 60 comprising a first spring 61 and a bead 62 therein. A first groove 114 is defined in the outer periphery of the cylindrical top 11 and located close to the top of the cylindrical top 11. The flange 12 has a protrusion 121 extending from a top thereof.

A pawl set 50 including two pawls 51 and each pawl 51 includes a shaft 511 and a ratchet tooth 512 which is connected to the shaft 511. The two shafts 511 of the two pawls 51 are respectively inserted in the two holes 112 in the two recesses 111. Each of the ratchet teeth 512 includes a recess 513 defined in a rear side thereof and two second springs 52 are respectively engaged with the two recesses 513 and bias between the two pawls 51 and two respective insides of the two recesses 111 so that the ratchet teeth 512 are maintained to be extended outward. The two shafts 511 of the two pawls 51 extend above a top surface of the cylindrical top 11 and a flexible band 53 connect the two shafts 511 over the top surface of the cylindrical top 11, so that the two pawls 51 are well positioned.

Figure 4:
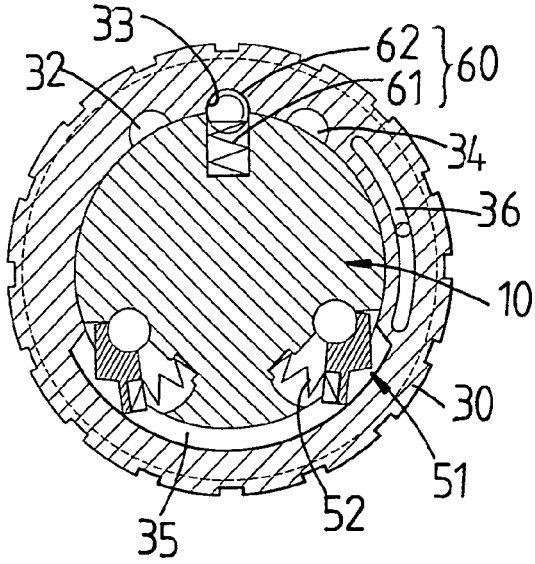
FIG. 4 is a cross sectional view taken from line A—A in FIG. 3.

A ring 30 is rotatably mounted to the cylindrical top 11 and has three notches 32, 33, and 34 defined in an inner periphery thereof. The bead 62 can be engaged with one of the notches 32, 33 and 34. A concaved area 35 is defined in the inner periphery of the ring 30 and when the two pawls 51 are located in the concaved area 35, the ratchet teeth 512 extend outward as shown in FIG. 4. At the position, the bead 62 is engaged with the notch 33.

A driving member 20 has an engaging top section 21 and a skirt portion, teeth 22 defined in an inner periphery of the skirt portion. The skirt portion is mounted to the cylindrical top 11 and includes a second groove 23 defined in the inner periphery thereof so that a C-shaped clamp 40 is engaged with the first groove 114 and the second groove 23 so as to connect the driving member 20 to the base 10. The teeth 22 are engaged with the at least one of the two ratchet teeth 512 of the two pawls 51. The ring 30 is sandwiched between the flange 12 and a lower edge of the skirt portion of the driving member 20. The ring 30 has a slot 36 defined longitudinally therethrough in which the protrusion 121 of the base 10 is movably retained so as to limit the rotational movement of the base 10. The engaging top section 21 has a polygonal outer contour and a top hole is defined in a top of the engaging top section 21 so as to receive a bit or the like therein.

Figure 5:
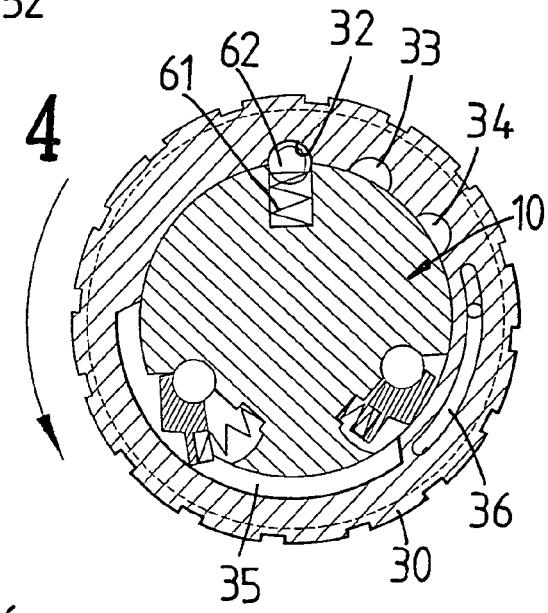
FIG. 5 shows when rotating the ring, the right pawl is compressed by the inner periphery of the ring.
Figure 6:
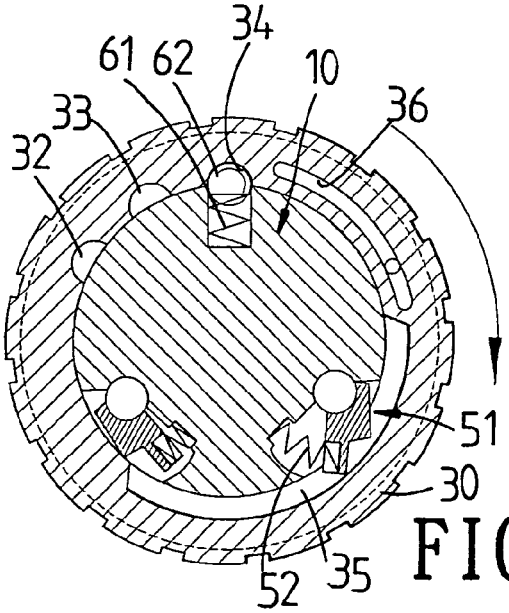
FIG. 6 shows when rotating the ring in opposite direction, the left pawl is compressed by the inner periphery of the ring.
Figure 7:
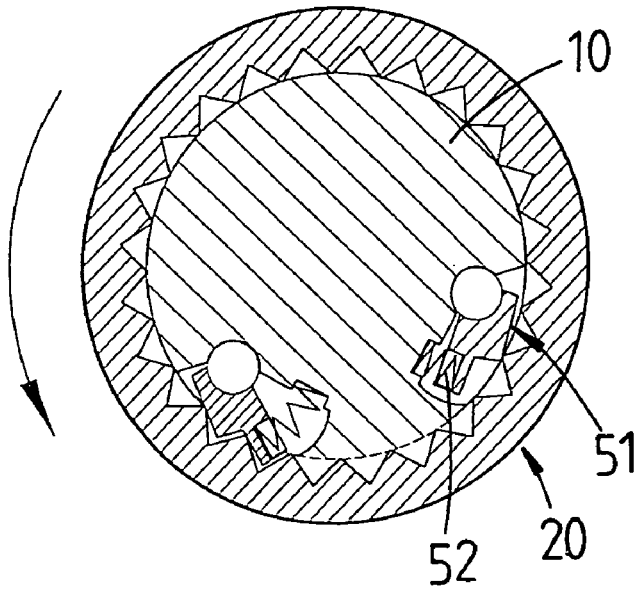
FIG. 7 is a cross sectional view taken from line B—B in FIG. 3 wherein the right pawl is compressed by the inner periphery of the ring.
Figure 8:
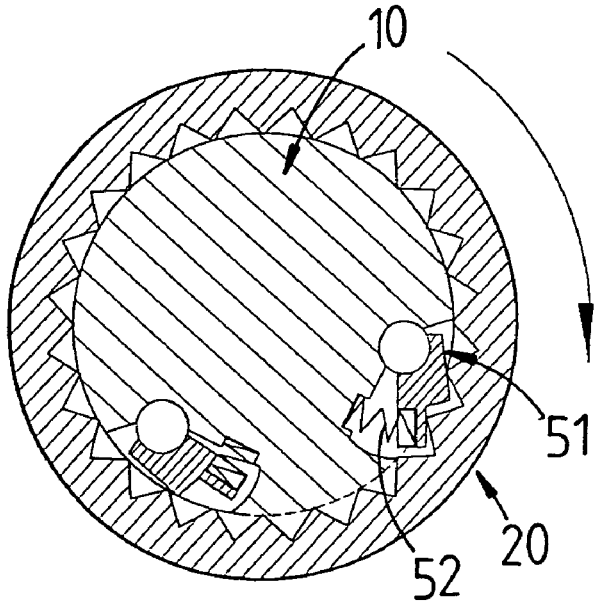
FIG. 8 is a cross sectional view taken from line B—B in FIG. 3 wherein the left pawl is compressed by the inner periphery of the ring.
Figure 9:
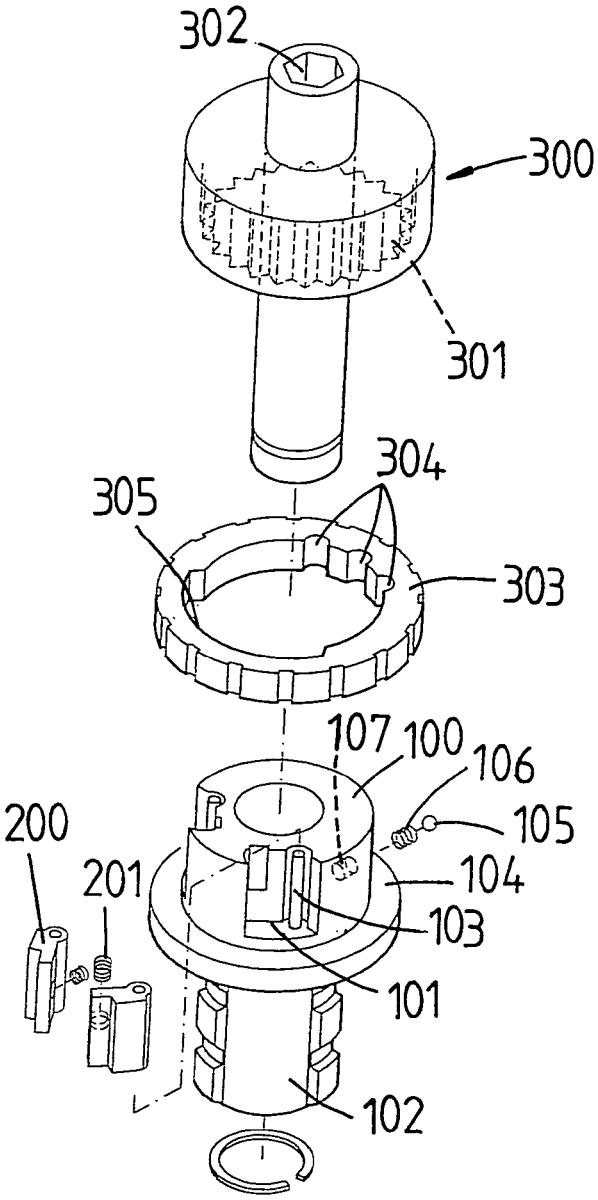
FIG. 9 PRIOR ART
FIG. 9 is an exploded view to show a conventional ratchet wrench.
Figure 10:
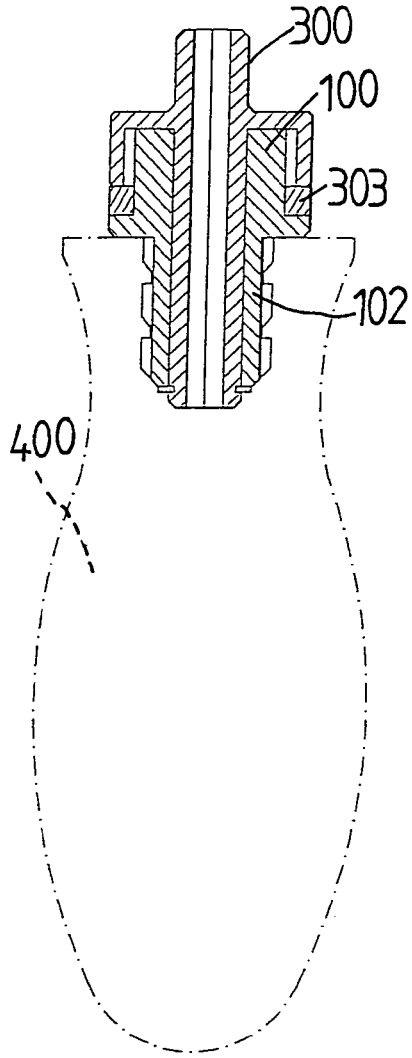
FIG. 10 PRIOR ART
FIG. 10 shows a cross sectional view of the conventional ratchet wrench.

As shown in FIGS. 5 and 6, when rotating the ring 30 counter clockwise, the right pawl 512 on the drawing is pressed by the inner periphery of the ring 30 and only the left pawl 512 is extended outward and engaged with the teeth 22 of the driving member 20. At this position, the bead 62 is engaged with the notch 32. Similarly, as shown in FIGS. 6 and 8, when rotating the ring 30 clockwise to shift the bead 62 from the notch 33 to the notch 34, the left pawl 512 on the drawing is pressed by the inner periphery of the ring 30 and only the right pawl 512 is extended outward and engaged with the teeth 22 of the driving member 20. By the rotation of the ring 30, the ratchet movement of the wrench can be adjusted.

It is noted that, the base 10 does not include small parts such as the pins 103 in the recesses 111 so that the base 10 is easily to be made and the wrench is easily to be assembled.

While we have shown and described the embodiment in accordance with the present invention, it should be clear to those skilled in the art that further embodiments may be made without departing from the scope of the present invention.

What is claimed is:

1. A ratchet wrench comprising:

a base including a cylindrical top, a flange extending radially outward from the cylindrical top and an insertion which is adapted to be connected to a handle, two recesses defined in an outer periphery of the cylindrical top and a hole defined in an inner bottom of each of the two recesses, a receiving hole defined in an outer periphery of the cylindrical top and receiving a first spring and a bead therein;

two pawls each including a shaft and a ratchet tooth connected to the shaft, the two shafts of the two pawls respectively inserted in the two holes in the two recesses, two second springs respectively biased between the two pawls and two respective insides of the two recesses, the two shafts of the two pawls extending above a top surface of the cylindrical top and a hand connected between the two shafts over the top surface of the cylindrical top;

a ring rotatably mounted to the cylindrical top and having three notches defined in an inner periphery thereof, the bead being engaged with one of the notches, a concaved area defined in the inner periphery of the ring, and a driving member having an engaging top section and a skirt portion, teeth defined in an inner periphery of the skirt portion and engaged with the at least one of the two ratchet teeth of the two pawls, the ring sandwiched between the flange and a lower edge of the skirt portion of the driving member.

2. The ratchet wrench as claimed in claim 1, wherein the engaging top section has a polygonal outer contour.

3. The ratchet wrench as claimed in claim 1, wherein the engaging top section has an engaging recess defined in a top thereof.

4. The ratchet wrench as claimed in claim 1, wherein the flange has a protrusion extending from a top thereof and the ring has a slot defined longitudinally therethrough in which the protrusion is movably retained.

* * * * *